US012144371B2

(12) United States Patent
Shoor et al.

(10) Patent No.: US 12,144,371 B2
(45) **Date of Patent: *Nov. 19, 2024**

(54) FILTER HAVING A SHAPED RIM STRUCTURE AND A FLAVOR CAPSULE

(71) Applicant: Good Tree International, Inc., Ontario, CA (US)

(72) Inventors: Kunal Shoor, Ontario, CA (US); Brandon Puett, Ontario, CA (US); Remberto Andres Estrella Gomez, Santiago (DO)

(73) Assignee: Good Tree International, Inc., Ontario, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/302,435

(22) Filed: Apr. 18, 2023

(65) Prior Publication Data

US 2023/0248055 A1 Aug. 10, 2023

Related U.S. Application Data

(63) Continuation of application No. 17/511,337, filed on Oct. 26, 2021.

(51) Int. Cl.

| | |
|---|---|
| ***A24D 3/06*** | (2006.01) |
| ***A24D 3/04*** | (2006.01) |
| ***A24D 3/10*** | (2006.01) |

(52) U.S. Cl.

CPC ..... *A24D 3/061* (2013.01); *A24D 3/048* (2013.01); *A24D 3/10* (2013.01)

(58) Field of Classification Search

CPC ..... A24D 3/061; A24D 3/048; A24D 3/10

See application file for complete search history.

(56) References Cited

U.S. PATENT DOCUMENTS

| | | | |
|---|---|---|---|
| 2,164,702 | A | 7/1939 | Davidson |
| 3,199,515 | A | 8/1965 | Lowe |

(Continued)

FOREIGN PATENT DOCUMENTS

| | | | |
|---|---|---|---|
| CN | 101203148 | B | 9/2012 |
| GB | 2549803 | | 11/2017 |

(Continued)

OTHER PUBLICATIONS

Amazon King Palm, Jul. 24, 2018 (Year: 2018), 2 pages.

(Continued)

*Primary Examiner* — Christopher M Rodd
*Assistant Examiner* — Daniel Edward Vakili
(74) *Attorney, Agent, or Firm* — DICKINSON WRIGHT RLLP; Mark W. Catanese

(57) ABSTRACT

A device for use while burning smoking material and inhaling the resulting smoke is disclosed. The device can include a filter comprising a filter element having a shaped rim structure and a recess formed in a surface of a body of the filter along a curved face extending from the first end to the second end, the recess extending radially into the body. The smoking accessory can include a capsule containing a flavoring agent disposed within the recess. The device may be received by a first end a tubular member formed to receive a smoking material, that when burned passes smoke into the device.

20 Claims, 6 Drawing Sheets

(56) References Cited

U.S. PATENT DOCUMENTS

| | | | | |
|---|---|---|---|---|
| 3,490,461 | A * | 1/1970 | Osmalov | A24D 1/04 131/10.5 |
| 3,550,508 | A | 12/1970 | Wartman, Jr. | |
| 3,910,288 | A | 10/1975 | Hammersmith | |
| 4,865,056 | A | 9/1989 | Tamaoki | |
| 4,889,144 | A | 12/1989 | Tateno | |
| 5,568,819 | A | 10/1996 | Gentry | |
| 6,041,790 | A | 3/2000 | Smith | |
| 7,152,609 | B2 | 12/2006 | Li | |
| 7,578,298 | B2 | 8/2009 | Karles | |
| 7,793,665 | B2 | 9/2010 | Dube | |
| 7,827,997 | B2 | 11/2010 | Crooks | |
| 7,836,895 | B2 | 11/2010 | Dube | |
| 7,856,992 | B2 | 12/2010 | Zhou | |
| 7,878,962 | B2 | 2/2011 | Karles | |
| 7,984,719 | B2 | 7/2011 | Dube | |
| 8,051,859 | B2 | 11/2011 | Yadav | |
| 8,066,011 | B2 | 11/2011 | Clark | |
| 8,118,035 | B2 | 2/2012 | Miser | |
| 8,235,056 | B2 | 8/2012 | Zhuang | |
| 8,356,607 | B2 | 1/2013 | Inoue | |
| 8,459,272 | B2 | 6/2013 | Karles | |
| 8,739,802 | B2 | 6/2014 | Fagg | |
| 9,010,337 | B2 | 4/2015 | Kobal | |
| 9,066,541 | B2 | 6/2015 | Allen | |
| 9,107,452 | B2 | 8/2015 | Deevi | |
| 9,119,421 | B2 | 9/2015 | Li | |
| 9,149,072 | B2 | 10/2015 | Conner | |
| 9,307,788 | B2 | 4/2016 | Dube | |
| 9,332,786 | B2 | 5/2016 | Yokogawa | |
| 9,554,594 | B2 | 1/2017 | Clark | |
| 9,872,517 | B2 | 1/2018 | Reed | |
| 9,907,335 | B2 | 3/2018 | Karles | |
| 10,321,710 | B2 | 6/2019 | Kobal | |
| 10,357,057 | B2 | 7/2019 | Kadiric | |
| 10,568,356 | B2 | 2/2020 | Karles | |
| 10,609,955 | B2 | 4/2020 | Beard | |
| 10,736,351 | B2 | 8/2020 | Kaihatsu | |
| 10,765,143 | B2 | 9/2020 | Mishra | |
| 10,893,700 | B2 | 1/2021 | Mishra | |
| 11,019,842 | B2 | 6/2021 | Dube | |
| 11,076,632 | B1 | 8/2021 | Ormaza | |
| 11,311,044 | B2 | 4/2022 | Shoor | |
| 11,700,879 | B2 | 7/2023 | Shoor | |
| 11,744,281 | B2 | 9/2023 | Shoor | |
| 11,910,821 | B2 | 2/2024 | Shoor | |
| 2006/0078608 | A1 | 4/2006 | Gilinski | |
| 2006/0135335 | A1 | 6/2006 | Dawson | |
| 2006/0174901 | A1 | 8/2006 | Karles | |
| 2007/0012327 | A1 | 1/2007 | Karles | |
| 2007/0068543 | A1 | 3/2007 | Chen | |
| 2007/0246054 | A1 | 10/2007 | Gedevanishvili | |
| 2011/0023896 | A1 * | 2/2011 | Dube | A24B 15/30 131/275 |
| 2012/0024303 | A1 | 2/2012 | Sugai | |
| 2012/0097179 | A1 | 4/2012 | Kesselman | |
| 2012/0255569 | A1 * | 10/2012 | Beard | A24D 3/04 131/334 |
| 2013/0333710 | A1 | 12/2013 | Brown | |
| 2014/0053855 | A1 | 2/2014 | Hartmann | |
| 2014/0202479 | A1 * | 7/2014 | Nicholls | A24D 3/04 131/337 |
| 2014/0332014 | A1 | 11/2014 | Penrose | |
| 2015/0027477 | A1 | 1/2015 | Yoshino | |
| 2015/0164133 | A1 | 6/2015 | Davis | |
| 2015/0296875 | A1 | 10/2015 | Camus | |
| 2017/0000185 | A1 | 1/2017 | Risso | |
| 2018/0160724 | A1 | 6/2018 | Guyard | |
| 2020/0100539 | A1 | 4/2020 | Mendoza | |
| 2020/0146340 | A1 | 5/2020 | Alderman | |
| 2020/0268043 | A1 * | 8/2020 | Partouche | A24D 3/04 |
| 2021/0169140 | A1 * | 6/2021 | Hejazi | A24B 15/12 |
| 2023/0130063 | A1 * | 4/2023 | Shoor | A24B 15/283 131/337 |

FOREIGN PATENT DOCUMENTS

| | | |
|---|---|---|
| KR | 20070100422 | 10/2007 |
| UA | 105677 C2 | 6/2014 |
| WO | 03009711 | 2/2003 |
| WO | 2015014610 | 2/2015 |
| WO | 2015091792 | 6/2015 |
| WO | 2020142002 | 7/2020 |
| WO | 2022129613 | 6/2022 |

OTHER PUBLICATIONS

English machine translation of abstract of CN 10372641 0A; Apr. 16, 2014; Liu; 2 pages. (Year: 2014).

English machine translation of abstract of WO 9725886 A1; Roca; Jul. 24, 1997; 4 pages. (Year: 1997).

English machine translation of CN 105813483 A; Jul. 27, 2016; Reed; 19 pages. (Year: 2016).

English machine translation of JP 2017503477 A1; Feb. 2, 2017; 13 pages. (Year: 2017).

English machine translation of KR20070100422; Oct. 10, 2007; 14 pages; Karles. (Year: 2007).

English machine translation of TW202041156A; Nov. 16, 2020; Kiew; 46 pages. (Year: 2020).

English machine translation of UA 105677 C2; Jun. 10, 2014; 38 pages. (Year: 2014).

English machine translation of WO 2011086751 A1; Kato; Jul. 21, 2011; 31 pages. (Year: 2011).

King Palm "About US" web page at <URL: https://kingpalm.com/about>, Feb. 2019, retrieved from the Internet at <URL: https://web.archive.org/web/20190205084640/https://kingpalm.com/about#>, on Nov. 8, 2022, 4 pages.

King Palm "High Quality Natural Palm Leaf Blunts" web page at <URL: https://kingpalm.com/>, Jun. 12, 2018, retrieved from the Internet at <URL: https://web.archive.org/web/20180612075453/https://kingpalm.com/>, on Nov. 8, 2022, 4 pages.

King Palm Corn Husk Filters, Amazon.com, 2018, [online], retrieved from the Internet, [retrieved Nov. 28, 2023], <URL: https://www.amazon.com/King-Palm-Filters-Natural-Effective/dp/B07FTX7HLS>, (Year: 2018), 2 pages.

King Palm Slim Size Cones, Amazon.com, 2017, [online], retrieved from the Internet, [retrieved Nov. 28, 2023], <URL: https://www.amazon.com/Slim-Size-Palm-Leafs-Pack/dp/B077GBKCDX/ref=sr_1_6?crid=3C7HBR2ONZMWI&keywords=king%2Bpalm%2Bcones&qid=1701208254&s=hpc&sprefix=King%2BPalm%2Chpc%2C92&sr=1-6&th=1 >, (Year: 2017), 4 pages.

* cited by examiner

FILTER HAVING A SHAPED RIM STRUCTURE AND A FLAVOR CAPSULE

CROSS-REFERENCE TO RELATED APPLICATIONS

This application is a continuation of U.S. patent application Ser. No. 17/511,337, filed Oct. 26, 2021, entitled "FILTER HAVING A SHAPED RIM STRUCTURE AND A FLAVOR CAPSULE", which is hereby incorporated herein by reference in its entirety.

TECHNICAL FIELD

This disclosure relates to flavored smoking materials. More specifically, this disclosure relates to a filter having an elongated filter element with irregularly shaped rims and a flavor capsule contained within a filter element.

RELATED ART

Hand-rolled cigarettes, cigars, or cigarillos generally do not have an incorporated filter. Filters can be purchased and included in such a hand-rolled smoke, but these are commonly formed from synthetic materials such as cellulose acetate (a plastic) and rayon. The cellulose acetate tow fibers are thinner than sewing thread, white, and packed tightly together to form a filter element and included in the hand-rolled smoke. Burning or inhaling such synthetic fibers can create hazardous situation for the smoker. In addition, flavors are not easily added to hand-rolled cigarettes, cigars, or cigarillos.

SUMMARY

One aspect of the disclosure provides a smoking accessory. The smoking accessory can include a filter having a body extending from a first end to a second end. The filter can have a filter element having an elongated structure extending from the first end to the second end, and the elongated structure having shaped rims at the first and second end. The filter element can have at least one channel surrounded by the shaped rims and a plurality of channels on an outer side of the shaped rims. The filter can have a recess formed in at least a surface of the body along a curved face extending from the first end to the second end, the recess extending radially into the body. The smoking accessory can include a capsule containing a flavoring agent disposed within the recess.

Another aspect of the disclosure provides a filter. The filter comprises a body, an elongated filter element having irregularly shaped rims, and a recess formed in a surface of the body, the recess extending radially through the body. The filter can have a capsule containing a flavoring agent disposed within the recess. The body can be at least one of a cylindrical body and a truncated conical body.

Other features and advantages will be apparent to one of ordinary skill with a review of the following description.

BRIEF DESCRIPTION OF THE DRAWINGS

The details of embodiments of the present disclosure, both as to their structure and operation, can be gleaned in part by study of the accompanying drawings, in which like reference numerals refer to like parts, and in which.

DETAILED DESCRIPTION

Reference throughout this specification to "one embodiment" or "an embodiment" means that a particular feature, structure, or characteristic described in connection with the embodiment is included in at least one embodiment. Thus, appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Figure 1:
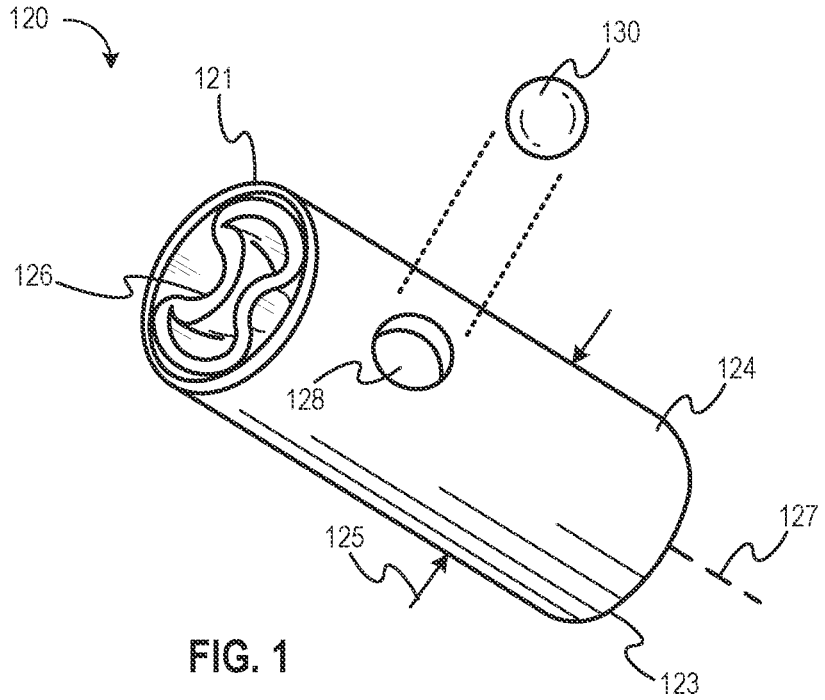
FIG. 1 is a perspective view of an embodiment of a filter.

FIG. 1 is a perspective view of an embodiment of a filter 120. In the illustrative example shown in FIG. 1, the filter 120 can have a cylindrical body/shape extending from a first end 121 to a second end 123 and having an outer diameter 125. The filter 120 can have a central axis 127 following an imaginary line through the center of the filter 120 from the first end 121 to the second end 123. The description refers to axial and radial directions. Axial refers to directions along the central axis 127, while radial refers to a direction orthogonal to the central axis 127. The filter 120 may be configured to be received within an end of a tubular member in an interference or friction fit, for example, as described below in connection to FIGS. 8 and 9. In some examples, the filter 120 may be rolled into corn husk, dried leaf, or paper member (e.g., also referred to a wrap) when forming the filter 120. That is, in various embodiments, the filter 120 may be a distinct body that may, while used in conjunction with a separately provided tubular member, operate as a smoking accessory acting on smoke drawn through the filter 120. The filter 120 can have a filter wrapper 124 (e.g., a plug wrap) enclosing a filter element 126, housed within the filter wrapper 124.

Figure 2:
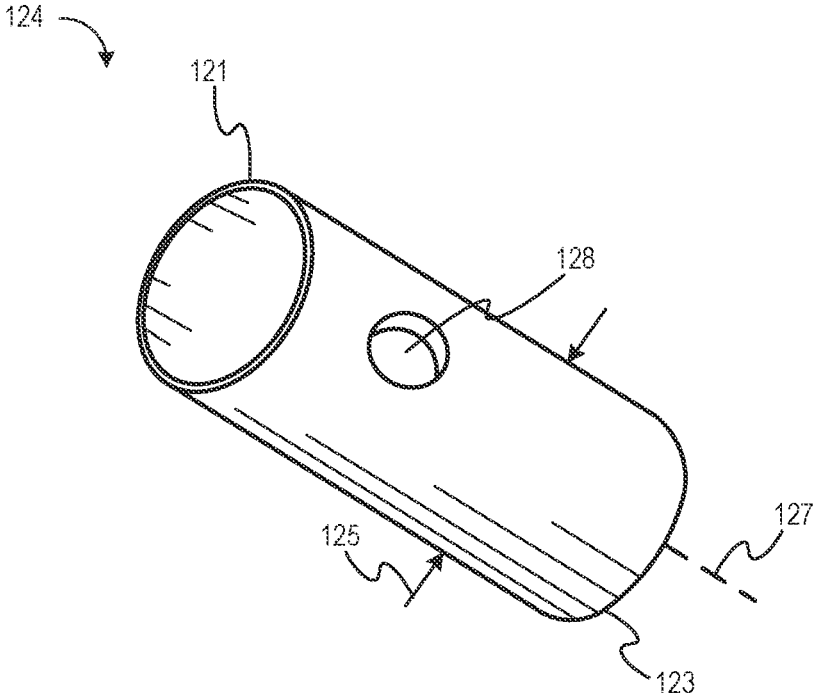
FIG. 2 is a perspective view of the filter wrapper of FIG. 1, with the filter element removed.
Figure 3:
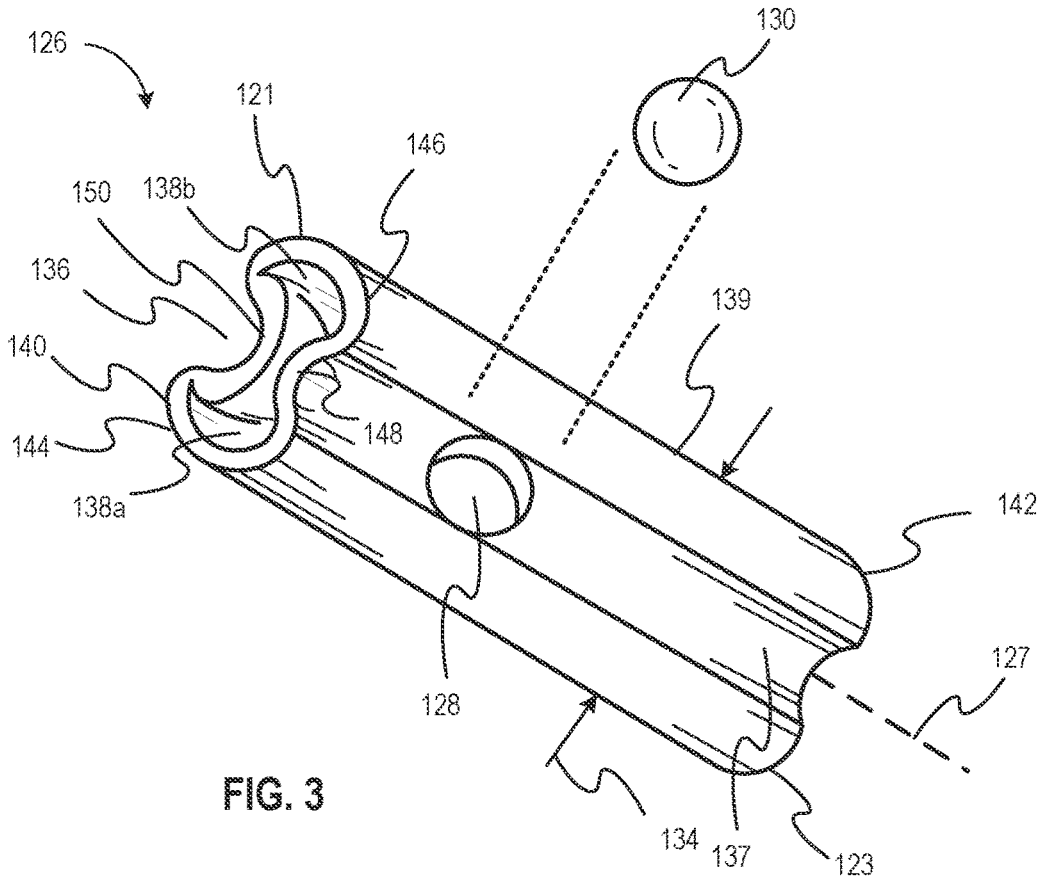
FIG. 3 is a perspective view of the filter element of FIG. 1, with the filter wrapper removed.

FIG. 2 is a perspective view of the filter wrapper 124, with the filter element 126 removed. FIG. 3 is a perspective view of the filter element 126, with the filter wrapper removed. FIGS. 1-3 are referenced in the following description.

The filter element 126 may comprise an elongated structure 139 extending between ends 121 and 123. The filter element structure 139 comprises shaped rims 140 and 142 at each end 121 and 123, respectively, and a plurality of channels 136-138. As shown in FIG. 3, rim 140 comprises a plurality of curved sections 144-150 arranged in the radial direction around axis 127. Rim 140 includes a first convex curved section 144, a second convex curved section 146 opposite the first convex curved section 144 in the radial direction. Rim 140 also includes first concave curved section 148 connected between first ends of the first and second convex curved sections 144 and 146. A second concave curved section 150 is provided opposite the first concave curved section 148 in the radial direction and connected between second ends of the first and second convex curved sections 144 and 146. Rims 140 and 142 may be similarly shaped thus having similarly arranged curved sections. The shape of rims 140 and 142 may be referred to as an "X" shape, a "FIG. 8" shape, or an hourglass shape when viewed along the central axis 127.

Rims 141 and 142 may be shaped such that there a plurality of channels are provided within the filter 120. In the illustrative example shown in FIG. 3, at least one channel 138 is provided within the structure 139 (e.g., surrounded by the rims 141 and 142), a channel 136 is provided on one side of the structure 139 in the radial direction, and a channel 137 is provided on another side for the structure 139 in the radial direction. In the example of FIG. 3, channel 137 may be provided opposite channel 136 in the radial direction. Channel 138 may comprise of an upper channel 138*b* and a lower channel 138*a* formed by the arrangement of the plurality of curved sections 144-150. The upper channel 138*b* and lower channels 138*a* may be in fluid communication or separated, for example, where apexes of the concave curved sections 148 and 150 contacted each other. Diameter 134 of filter element 136 can be approximately equal to the internal diameter of an elongated internal cavity of the filter wrapper 124, such that the curved sections 144 and 146 may be in contact with the internal surface of filter wrapper 124. The filter element 126 may be configured to be received within the filter wrapper 124 in an interference or friction fit, for example, at points of contact between filter element 126 and filter wrapper 124.

The filter element 126 can be formed from natural fibers. For example, the filter element can comprise of a dried leaf, such as any natural plant leaf that can be rolled formed into the desired shape. In some examples, the material of the filter element can be a tree or plant leaf such as, corn husk, Cordia, manjack, bocote, palm, or other leaves. Cordia is an example used herein, but is not limiting on the disclosure. Cordia can include flowering plants (e.g., shrubs and trees) in the borage family, Boraginaceae. In general, the material can be a thick, pure and all natural leaf (i.e., no additives), without glue or other adhesives, and green leaf. The filter element 126 can also be tobacco free. The material can provide a resiliency and burns slowly.

In some examples, the filter element 126 may be paper material, such as any thin sheet material produced by processing fibers derived from plant or tree sources in water and then pressing and drying the material produce a sheet of material. The paper material can be any type of paper, such as but not limited to, rice paper, hemp paper, palm paper (e.g. made by processing Cordia fibers), wood pulp, bleached paper (e.g., sometimes referred to as white paper), unbleached paper (e.g., sometimes referred to as brown paper), clear paper (e.g., paper made from cellulose resulting in a clear sheet), colored papers, gold rolling papers. For example, different paper material may be used to provide differing aesthetics, such as different colored papers or papers having designs printed thereon. In various examples, the material 110 may be entirely made of palm paper (e.g. made by processing Cordia fibers). Using paper material, such as hemp paper, palm paper, etc., may provide benefits, such as for example but not limited to, being thinner and more flexible than the dried leaf embodiments described above. Particularly, palm paper may provide a material that is both thin and flexible, while resilient to breakage and/or tearing. Another benefit of palm paper is that palm paper is one of the slowest burning papers and is tobacco-free. The Cordia leaf (or fibers therefrom) is durable and absorbs liquid (e.g., from the capsule 130 as described below) in a manner that is more resilient than that provided by papers or leaf from other plants. The paper material may be provided as strips of paper that can be cut and rolled (e.g., hand-rolled or machine-rolled) into the desired shape.

In some examples, the filter element 126 can be formed by rolling the material into the desired shape. In some embodiments, the material forming the filter element 126 can be shredded and then rolled (e.g., hand-rolled or machine-rolled) into the desired shape, forming the filter element 126. In another example, the material may be provided in sheets that are layered and then formed in the shape of structure 139.

In some implementations, the filter element 126 can be held in the shape by the filter wrapper 124. The filter wrapper 124 can be a section of ordinary paper (e.g., kraft paper and the like) wrapped around the filter element 126. The filter wrapper 124 may include an internal cavity configured to receive the filter element 126. Contact between the outer surface of the filter element 126 and the inner surface of the filter wrapper 124 provides for an interference or friction fit between the filter element 126 and filter wrapper 124.

In some implementations, the filter wrapper 124 can be a paper material as described above in connection to the material for the filter element 126. The paper material can be any type of paper, such as but not limited to, rice paper, hemp paper, Cordia (also referred to herein as palm paper), wood pulp, bleached paper (e.g., sometimes referred to as white paper), unbleached paper (e.g., sometimes referred to as brown paper), clear paper (e.g., paper made from cellulose resulting in a clear sheet), colored papers, gold rolling papers. In various examples, the filter wrapper 124 may be entirely made of Cordia (e.g., palm paper). In other implementations, the filter 124 can be formed of corn husk without any paper. In some other implementations, the filter wrapper 124 can be one or more sections (e.g., lengths) of string formed from natural fibers, as described above. The string can be wrapped and tied around, for example, the ends of the filter element 126 to maintain a cylindrical (e.g., tubular) shape.

In some implementations, the filter wrapper 124 can be rolled around a shaped form and dried in place to form the body of the filter 120. In some examples, the filter wrapper can be (fully or partially) dried and then rolled into the desired shape. Optionally, the filter 120 can be secured in a tubular form, for example with a ring or string (not shown) or with an outer casing (also referred to as an outer wrapper). The ring or string can be a section of paper or other appropriate fastener wrapped around and adhered to itself holding the filter wrapper in a hollow form/tubular shape and prevent the filter wrapper from unwrapping. The ring or string can further be adhered to the filter wrapper to maintain the tubular shape.

Embodiments described throughout this disclosure (for example, filter 120) may provide various non-limiting advantages. For example, the filter 120 and filter element packed therein may be configured to ensure that no loose smoking material inadvertently falls out of the tubular member. Similarly, the structure 139 of the filter element 126 may be provided to ensure that no loose material inadvertently falls out of the filter 120 (e.g., secures a capsule therein as described below). Additionally, the filter element 126 may prevent unwanted oils from entering a mouth of a user, for example, by absorbing oils produced by burning smoking material into the material of the filter element 126. Furthermore, implementations of filter 120 that employ corn husk, palm paper, etc. as the filter wrapper 124 and/or filter element 126 may provide advantages over conventional paper, for example, by providing an all-natural smoking experience through the use of non-GMO, organic filter material. Additionally, corn husk, palm paper, and etc. materials are exceptionally durable and resistant to tearing, enabling a user to manipulate the material free from damage concerns.

In accordance with various embodiments, the filter element 126 may provide advantages over conventional filter elements by employing structure 139 and channels 136-138. For example, channels 136-138 may provide improved airflow pathways across the body of the filter 120 (e.g., from end 123 to 121). For examples, channels 136-138 provide pathways for fluid communication to pass from one end of the filter 120 to another, with minimal air resistance, thereby increasing air flow during usage. Furthermore, structure 139 may provide improved structural integrity that is resistant to unintentional deformation via a rigidity provided by rims 140 and 142.

Figure 4:
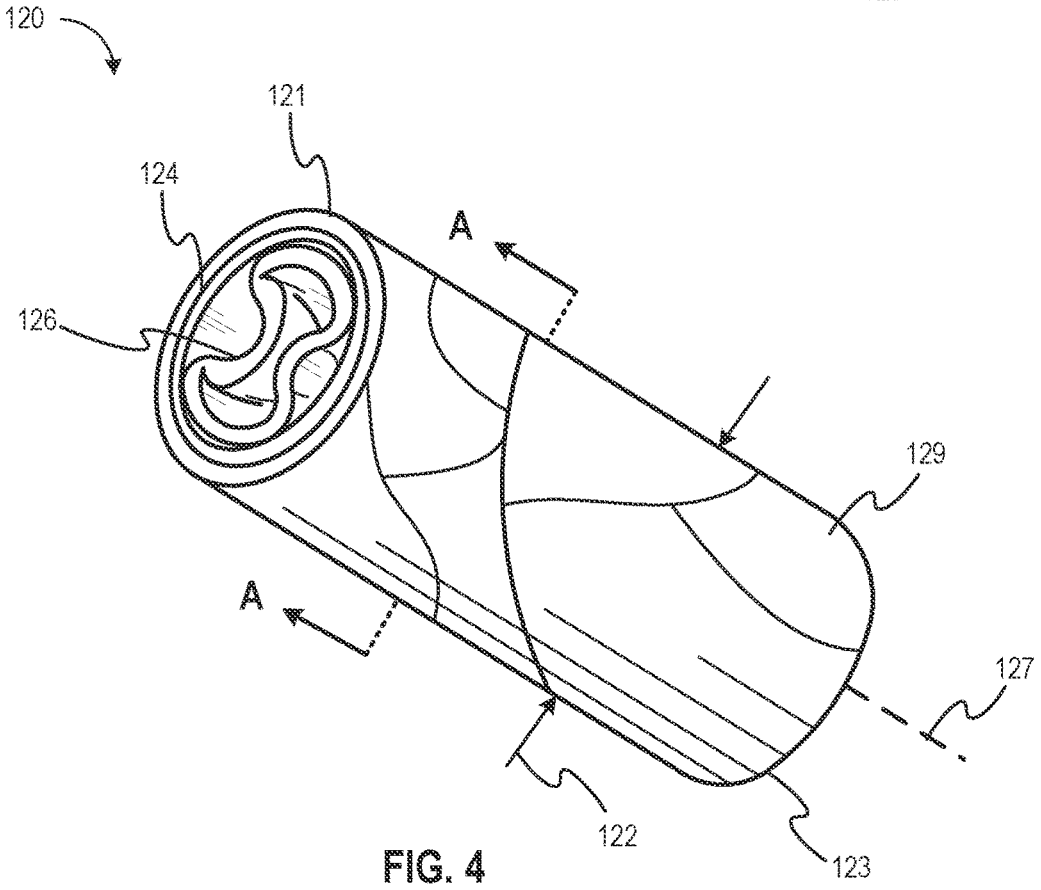
FIG. 4 is a perspective view of the filter of FIG. 1 including an outer casing.
Figure 5A:
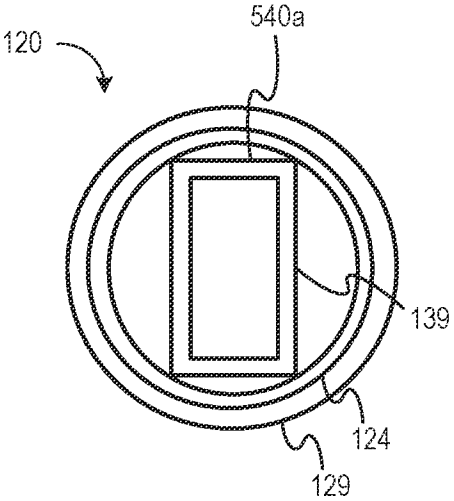
FIGS. 5A-5H illustrate various examples of the filter of FIG. 1, viewed along an axial direction, having differently shaped filter elements.
Figure 5B:
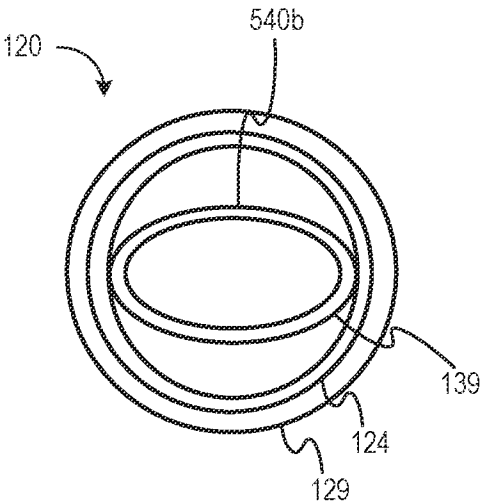
Figure 5C:
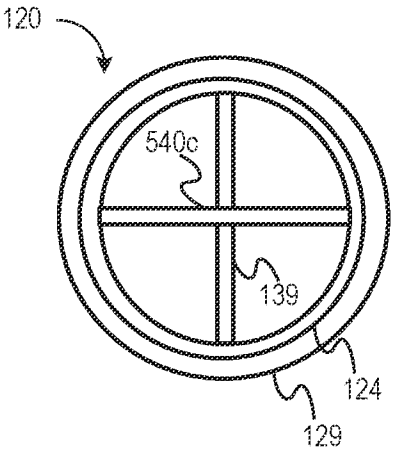
Figure 5D:
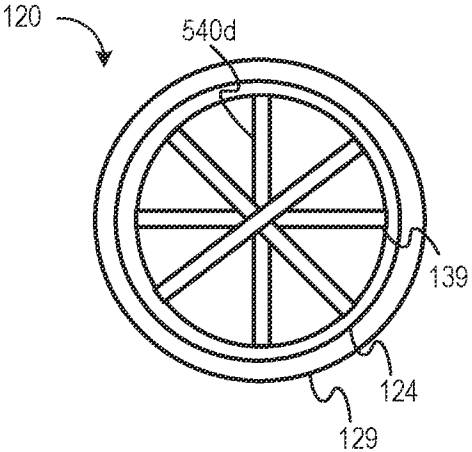
Figure 5E:
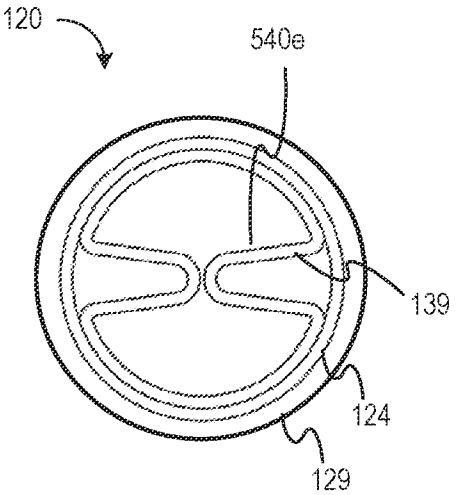
Figure 5F:
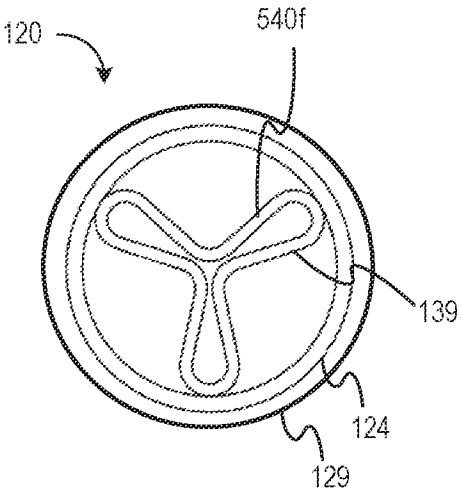
Figure 5G:
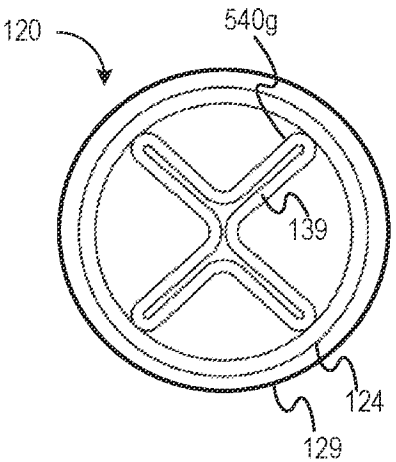
Figure 5H:
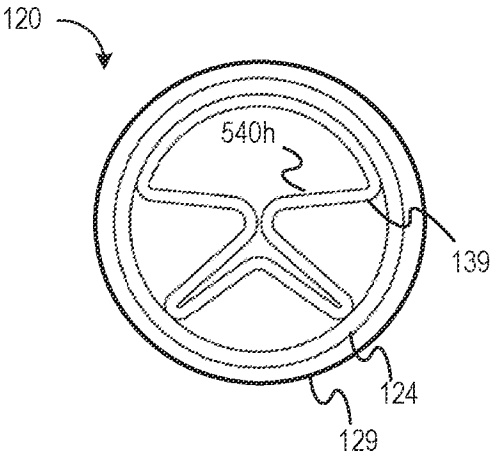

While an example of the structure 139 is provided herein with reference to rims 140 and 142, the scope of the present disclosure is not intended to be limited to only the shape shown in FIGS. 1, 3, and 4. For example, FIGS. 5A-5H illustrates examples of filter element 126 having different rims 540*a*-540*h*. For example, FIGS. 5A-5H illustrate the filter 120 when viewed from end 121 along the axial direction, each filter element 126 has structure 139 having a differently shaped rim. It will be appreciated that the rim at end 123 of each filter 120 may be shaped similarly to those shown in the figures. For example, FIG. 5A illustrates a square or rectangular shaped rim 540*a*, corners thereof in contact filter wrapper 124. As another example, FIG. 5B shows rim 540*b* having an ovular shape arrange such that a major axis of the rim 540*b* contacts the filter wrapper 124. Similarly, FIGS. 5E-5H show rims 540*e*-540*h* each having an alternative shape that contacts the filter wrapper 124 as illustrated. In yet other examples, the shape need not be continuous as, for example, as shown in FIGS. 5C and 5D. In FIGS. 5C and 5D, rim may comprise a plurality of substantially straight sections, each extending radially from one side of the filter wrapper to another side (e.g., through the central axis). Each straight section may intersect with the other straight sections at approximately the central axis 127. Thus, for example, two straight sections may cross forming a "+" sign shape (FIG. 5C). Where more than two straight sections are provided a star or asterisk shape may be provided (FIG. 5D).

FIG. 4 is a perspective view of an embodiment of the filter 120 including an outer casing 129 (also referred to as an outer wrapper 129). The filter 120 can have a tubular member formed as the outer casing 129 having an outer diameter of 122. The outer casing 129 can extend from the first end 121 to the second end 123.

The outer casing 129 can include elongated internal cavity extending between the first end 121 and the second end 123 along the central axis 127. The internal cavity can receive a filter wrapper 124 and filter element 126. The outer diameter 125 of the filter wrapper 124 can be approximately equal to the internal diameter of the elongated internal cavity of the outer casing 129. The filter wrapper 124 and filter element 126 may be received within the first end 121 of the outer casing in an interference or friction fit. In the illustrative example of FIG. 4, the outer casing 129 overlaps in the radial direction with the filter wrapper 124 and filter element 126 along the entire length of the filter wrapper 124. In another example, the outer casing 129 may overlap with a portion of the filter wrapper 124 that is less than the entire length, thereby leaving the remaining portion or portions of the filter wrapper exposed.

In some implementations, the outer casing 129 can formed of dried leaf, corn husk, paper (e.g., kraft paper), and the like. In some examples, material of the outer casing 129 can be any natural plant leaf that can be rolled into a tube. In some examples, the dried leaf can be a tree or plant leaf such as, Cordia, manjack, bocote, palm, or other leaves. Cordia is a primary example used herein, but is not limiting on the disclosure. Cordia can include flowering plants (e.g., shrubs and trees) in the borage family, Boraginaceae. In general, the dried leaf can be a pure and all natural leaf (i.e., no additives), without glue or other adhesives, and green leaf. The dried leaf can also be tobacco free. The dried leaf can provide a resilient and aesthetically appealing green that burns slowly. When the outer casing is formed of corn husk, the corn husk can be rolled to form the tubular shape of the outer casing 129. The corn husk may pure and all natural (e.g., organic with no additives and non-GMO), without glue or other adhesives. The corn husk may be resilient to tearing and durable to provide a casing that holds the filter 120 together.

The outer casing 129 can be rolled around a form and dried in place to form the tubular member shape of the filter. In some examples, dried leaf or corn husk can be (fully or partially) dried and then rolled into the desired shape. The outer casing 129 can be secured in a tubular form with a ring or string (not shown). The ring or string can be a section of paper or other appropriate fastener wrapped around and adhered to itself holding the outer casing in its hollow form/tubular shape and prevent the filter from unwrapping. The ring can further be adhered to the outer casing 129 to maintain the tubular shape.

In an example method of forming the filter 120, the filter element 126 may be provided on top of the material of the filter wrapper 124, which is layered on top of the material of the out casing 129. This layered arrangement forms a sheet of the various materials that may then be rolled (e.g., hand-rolled or machine-rolled) forming a long cylindrical shape. The resulting cylindrical shape may then be cut at desired intervals along the axial length of the shape to form individual filters, such as filter 120.

The filter 120 can have a recess 128. The recess 128 can be formed in a surface of the filter 120 along a curved face extending from the first end and the second end. In some embodiments, the recess 128 may be formed in the filter element 126 and the filter wrapper 124 for receiving a capsule 130.

Figure 6:
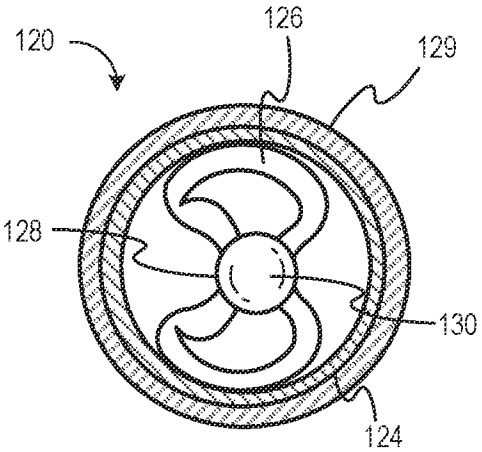
FIG. 6 is a cross-sectional view of an embodiment of the filter taken along the line A-A of FIG. 4.

FIG. 6 is a cross-sectional view of an embodiment of the filter 120 taken along the line A-A of FIG. 4. The recess 128 can be a cavity or orifice bored, punched, or otherwise formed in the surface of the filter wrapper 124. The recess 128 can extend into the cylindrical body of the filter 120. In some implementations, the recess 128 can penetrate the wrapper 124 and extend radially through the filter element 126. The recess 128 can penetrate both the filter wrapper 124 and the filter element 126 extending completely through the filter 120.

In other implementations, the recess 128 may not penetrate the wrapper 124 and thus be an indentation on the surface of the wrapper 124 and the filter 120. In general, a capsule 130 can be set within the recess 128 and thus contained within the recess 128 by the outer casing 129.

The recess 128 can be sized to receive the capsule 130. The capsule 130 can be a flavor capsule containing a flavoring agent. The capsule 130 can be a gelatin capsule. In other implementations, the capsule 130 can be formed from vegetable-based materials (e.g., a vegetable capsule). The flavoring agent can be a fluid operable to penetrate the filter element 126 and impart a flavor on the smoke drawn through the filter 120. The flavoring agent can be released when the capsule 130 is crushed. The flavoring agent within the capsule 130 can be, for example, a food grade essential oil or food grade candy oil. In some implementations, the flavoring agent can also include natural terpene liquid in various flavors (e.g., fruit or dessert flavors).

The recess 128 maybe be disposed at any axial position along the central axis 127 of the filter. For example, the recess 128 may be positioned closer to the first end 121 than the second end 123 along the axial direction. In this example, the first end 121 may be closer to a user's mouth than the second end 123, and thus the recess 128 and the flavor capsule may be adjacent to the mouth. In this arrangement, a user may have an improved experience as the flavoring agent is dispersed closer to the mouth of the user. In another example, the recess 128 may be positioned closer to second end 123 or anywhere in between the first end 121 and the second end 123.

In some examples, the capsule 130 is removably received within the recess 128. The recess 128 may be larger than the size of the capsule 130 such that the capsule 130 is moves within the recess 128. In these examples, the capsule 130 may be removed from the recess 128 and a different capsule inserted therein. As another example, the capsule 130 may be easily inserted into the recess 128 without applying a force to the capsule 130 and/or filter 120. This may minimize risk of bursting the capsule 130 and/or deforming the filter 120 during manufacture. Whereas, in some scenarios, if the capsule 130 is held in place by friction fit, insertion of the capsule 130 into the recess 128 may result in damage to the capsule 130 and/or filter 120 unless the insertion is performed with extra care.

In examples comprising the outer casing 129, the outer casing 129 may be configured to contain the capsule within the recess 128. For example, where the recess 128 penetrates the filter wrapper 124, the outer casing 129 may be provided to cover the cavity, orifice or opening of the recess 128. When the capsule 130 is housed within this recess 128, the outer casing 129 seals the opening and the capsule 130 is securely held within the recess 128. Similarly, where the recess 128 does not penetrate the filter wrapper 124 and the capsule 130 is set within an indentation in the filter wrapper 124, the outer casing 129 may cover the indentation and thereby cover the capsule 130. Accordingly, embodiments are able to securely contain the capsule 130 within the designated area of the filter 120 corresponding to the recess 128 through the use of the outer casing.

Additionally, or without the use of the outer casing 129, structure 139 may be configured to contain the capsule within the body of the filter 120 (e.g., within the internal cavity of the filter wrapper 124), such as within the recess 128. For example, where the recess 128 penetrates the filter element 126 and the capsule 130 is housed within this recess 128, the structure 139 of the filter element 126 holds the capsule 130 is securely held within the recess 128 such that the capsule does not shift along the central axis 127. Similarly, where the recess 128 does not penetrate the filter element 126 and the capsule 130 is set within a channel of the filter element 126, the outer casing 129 may cover the indentation and thereby cover the capsule 130. Accordingly, embodiments are able to securely contain the capsule 130 within the designated area of the filter 120 corresponding to the recess 128 through the use of one or more of the structure 139 and the outer casing 129.

Figure 7:
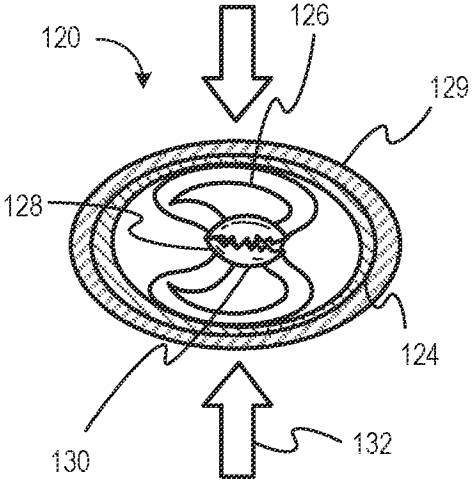
FIG. 7 is another view of the cross sectional view of FIG. 6.

FIG. 7 is another view of the cross section of FIG. 6. When an external force 132 (e.g., a pinching motion) is exerted on the filter 120 (e.g., on the filter 120 and, thusly, the capsule 130), the capsule 130 can be burst, releasing the flavoring agent into the filter element 126. The external force may be applied to one or more of the first end 121, second end 123, and anywhere therebetween such that the external force induces a pinching force applied to the capsule 130 within the filter element 126, thereby causing the capsule 130 to burst. The flavoring agent can be drawn into smoke that passes through the filter 120 via channels 136-138 providing improved airflow. Furthermore, the structure 139 may provide a tension force that, upon release of the external force 132, returns filter 120 to its original shape (or approximately to its original shape) due to a spring like response.

Figure 8:
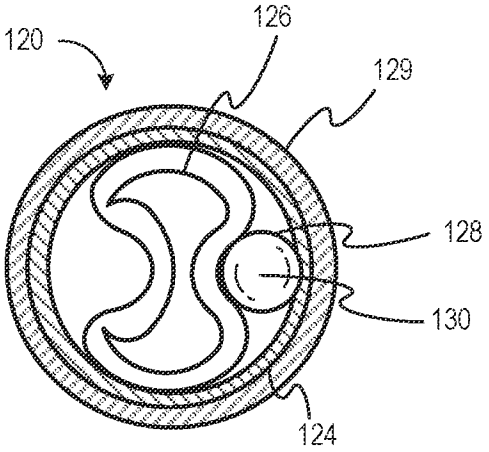
FIG. 8 is a cross-sectional view of another embodiment of the filter taken along the line A-A of FIG. 4.

FIG. 8 is a cross-section of another embodiment of the filter 120 taken along the line A-A of FIG. 4. In some implementations, the recess 128 can penetrate the wrapper 124 and extend radially into a portion of the filter element 126 but not all the way through the filter 120. For example, the capsule 130 may positioned within any of the channels 136-138 (e.g., channel 137 as shown in FIG. 8). Thus, the recess 128 can thus form a pocket within the filter 120 without deforming or otherwise altering the structure 139 of the filter element 126.

While some illustrative examples herein provide for a recess 128 formed in the surface of the filter 120, embodiments herein need not be so limited. For example, the recess 128 may be formed within the filter element 126 and the capsule 130 inserted into the recess. In some examples, the filter 120 may be formed around the capsule 130, for example, by packing or rolling the filter element 126 around the capsule 130 forming recess 128 that contains the capsule 130. The filter wrapper 124 may then be applied and wrapped around the filter element 126. In another example, the filter element 126 may be placed on an unrolled filter wrapper 124 and the capsule 130 placed on the filter element 126 (e.g., in a central position of the filter element 126) and the filter wrapper 126 rolled to form the filer 120, thereby packing or rolling the filter element 126 around the capsule 130.

While FIGS. 6-8 each illustrate the filter 120 comprising outer casing 129, this is for illustrative purposes only. It will be appreciated the description in connection with FIGS. 6-8 each apply equally to embodiments of filter 120 with or without the outer casing 129.

Figure 9:
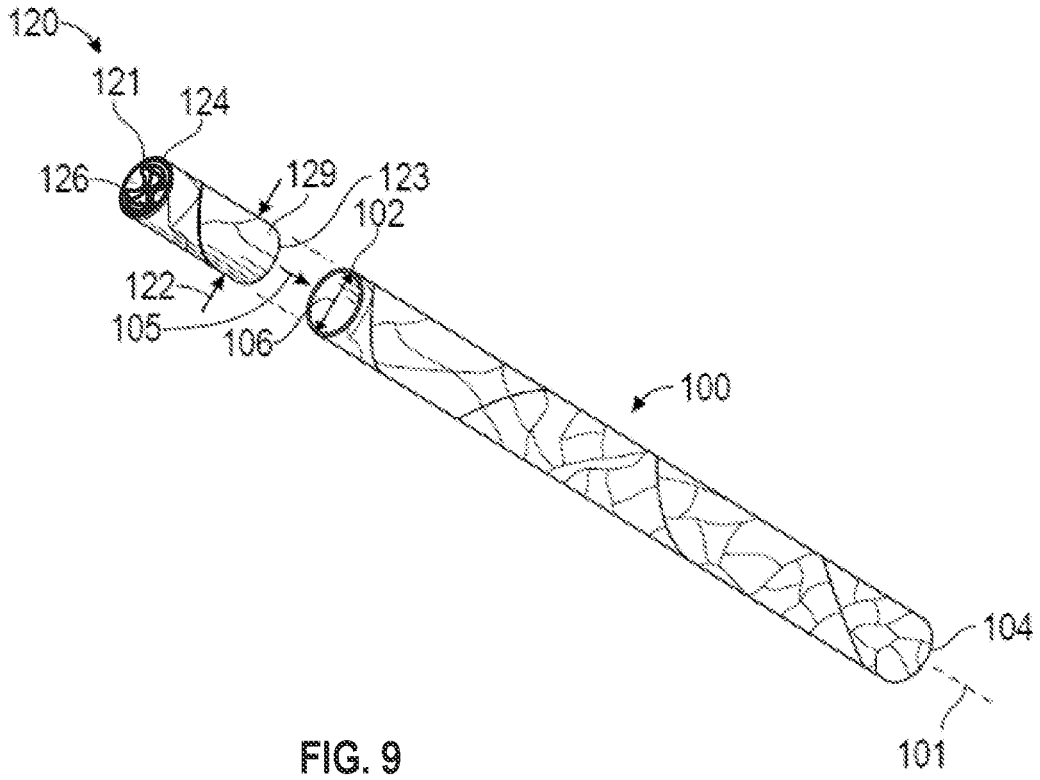
FIG. 9 is a perspective view of the filter received by a tubular member.
Figure 10:
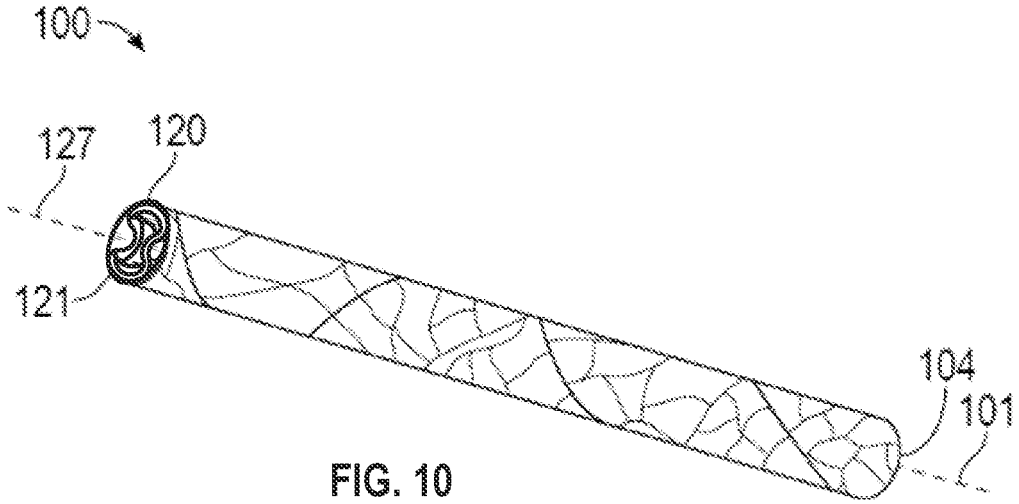
FIG. 10 is perspective view of the filter used with a hollow leaf tube.

FIG. 9 is a perspective view of an embodiment of a filter, according to the embodiments disclosed herein, being received by a tubular member. FIG. 10 is another perspective view of the tubular member of FIG. 9 having received the filter according to the embodiments herein. While FIGS. 9 and 10 each illustrate the filter 120 comprising outer casing 129, this is for illustrative purposes only. The following description of FIGS. 9 and 10 each apply equally to embodiments of filter 120 with or without the outer casing 129.

The tubular member 100 can be a leaf tube formed from a dried leaf or a wrapper for enclosing smoking material (such as plant based smoking material). The tubular member 100 may be formed by a wrapper (e.g., kraft paper, dried leaf, or the like) that is rolled to form the tubular member 100. The tubular member 100 can extend from a first end 102 to a second end 104. The first end 102 can be formed to receive the filter 120, forming a closed end of the tubular member 100. Receiving herein may refer to inserting the filter 120 into the first end 120 of the tubular member 100 (e.g., as shown by arrow 105). For example, where the filter 120 comprises the outer casing 129, the outer diameter 122 of the filter 120 can be received within end 102 of a tubular member 100 in an interference or friction fit. In another example, receiving as used herein may refer to placing the filter 120 onto the wrapper in an un-wrapped state and then forming the tubular member 100 around the filter 120. As another example, where the filter 120 does not include the outer casing 129, the outer diameter 125 of the filter 120 can be received within end 102 of a tubular member 100. That is, the filter 120 can be rolled into dried leaf or paper member when forming the tubular member 100.

The tubular member 100 can have a central axis 101 following an imaginary line through the center of the tubular member 100 from the first end 102 to the second end 104. A central axis 127 of the filter 120 may be substantially aligned with the central axis 101 of the tubular member 100.

The second end 104 can open into an elongated internal cavity 108 having an inner diameter 106. The internal cavity 106 can receive a filter 120 (FIG. 9). In some implementations, dried leaf can be any natural plant leaf that can be rolled into the tubular member. In some examples, the wrapper or material forming the tubular member 100 can be a paper or tree or plant leaf such as, Cordia, manjack, bocote, palm, or other leaves. Cordia is a primary example used herein, but is not limiting on the disclosure. Cordia can include flowering plants (e.g., shrubs and trees) in the borage family, Boraginaceae.

Other Aspects

The previous description is provided to enable any person skilled in the art to practice the various aspects described herein. Various modifications to these aspects will be readily apparent to those skilled in the art, and the generic principles defined herein may be applied to other aspects.

Thus, the claims are not intended to be limited to the aspects shown herein, but is to be accorded the full scope consistent with the language claims, wherein reference to an element in the singular is not intended to mean "one and only one" unless specifically so stated, but rather "one or more."

The word "exemplary" is used herein to mean "serving as an example, instance, or illustration." Any aspect described herein as "exemplary" is not necessarily to be construed as preferred or advantageous over other aspects. Unless specifically stated otherwise, the term "some" refers to one or more.

Combinations such as "at least one of A, B, or C," "one or more of A, B, or C," "at least one of A, B, and C," "one or more of A, B, and C," and "A, B, C, or any combination thereof" include any combination of A, B, and/or C, and may include multiples of A, multiples of B, or multiples of C. Specifically, combinations such as "at least one of A, B, or C," "one or more of A, B, or C," "at least one of A, B, and C," "one or more of A, B, and C," and "A, B, C, or any combination thereof" may be A only, B only, C only, A and B, A and C, B and C, or A and B and C, where any such combinations may contain one or more member or members of A, B, or C.

Although the present disclosure provides certain example embodiments and applications, other embodiments that are apparent to those of ordinary skill in the art, including embodiments which do not provide all of the features and advantages set forth herein, are also within the scope of this disclosure. Accordingly, the scope of the present disclosure is intended to be defined only by reference to the appended claims.

What is claimed is:

1. A filter for a smokable item, the filter comprising:
a body having a surface and an internal cavity extending between a first end and a second end;
one or more sheets of filter material, in a layered arrangement, disposed in the internal cavity and extending from the first end to the second end, the one or more sheets of filter material rolled to form an elongated structure provided as a filter element, the filter element comprising:
the elongated structure extending from the first end to the second end, the elongated structure having shaped rims at the first and second ends,
at least one channel surrounded by the shaped rims, and
a plurality of channels on an outer side of the shaped rims; and
a capsule containing a flavoring agent, the capsule located within a first channel of the plurality of channels, the capsule positioned between and in contact with both of the surface of the body and the outer side of the shaped rims.

2. The filter of claim 1, wherein the first channel extends from the first end to the second end.

3. The filter of claim 1, wherein the filter material comprises one or more of corn husk, Cordia, manjack, bocote, palm, rice paper, hemp paper, palm paper, wood pulp, bleached paper, unbleached paper, and clear paper.

4. The filter of claim 1, further comprising a filter wrapper housing the filter element.

5. The filter of claim 4, wherein the capsule is located between the filter wrapper and the elongated structure.

6. The filter of claim 5, wherein the capsule is held within the first channel by friction between the filter wrapper and the elongated structure.

7. The filter of claim 5, wherein the filter wrapper comprises one or more of corn husk, Cordia, manjack, bocote, palm, rice paper, hemp paper, palm paper, wood pulp, bleached paper, unbleached paper, and clear paper.

8. The filter of claim 1, wherein the surface is an inner surface of a filter wrapper housing the filter element.

9. The filter of claim 1, wherein crushing the capsule disperses the flavoring agent within the filter to impart a flavor into smoke.

10. The filter of claim 1, further comprising an outer casing that houses the body.

11. The filter of claim 1, wherein crushing the capsule disperses the flavoring agent into the filter.

12. The filter of claim 1,
the shaped rims comprise a first concave curved section running radially toward central axis, the first concave curved section having a concave apex, wherein the concave apex is located closer to the central axis than the concave apex is located to the surface of the body.

13. The filter of claim 12, wherein the shaped rims comprise a plurality of curved sections, the plurality of curved sections comprising:
a first convex curved section,
a second convex curved section opposite the first convex curved section,
the first concave curved section connected between the first and second convex curved sections, and
a second concave curved section opposite the first concave curved section connected between the first and second convex curved sections, wherein the concave apex of the first concave curved section contacts a concave apex of the second concave curved section.

14. A smoking accessory comprising:

an elongated member extending from a first end to a second end; and a filter disposed within the elongated member at the first end, the filter including:

a filter wrapper having an internal cavity extending from a third end to a fourth end, one or more sheets of filter material, in a layered arrangement, disposed in the internal cavity and extending from the third end to the fourth end, the one or more sheets of filter material rolled to form an elongated structure provided as a filter element housed by the filter wrapper, the filter element comprising the elongated structure extending from the third end to the fourth end, the elongated structure having shaped rims at the first and second ends, at least one channel surrounded by the shaped rims, and a plurality of channels on an outer side of the shaped rims, and a capsule containing a flavoring agent, the capsule located within a first channel of the plurality of channels, the capsule positioned between and in contact with the filter wrapper and a surface of the first channel.

15. The smoking accessory of claim 14, wherein at least one of the elongated member, the filter wrapper, and the filter element is formed of material comprising one or more of Cordia, manjack, bocote, palm, rice paper, hemp paper, palm paper, wood pulp, bleached paper, unbleached paper, and clear paper.

16. The smoking accessory of claim 14, wherein the elongated member has an internal cavity extending from an open end to a closed end, the internal cavity being configured to receive smoking material.

17. The smoking accessory of claim 16, wherein the filter is disposed within the internal cavity and the third end of the filter defining the closed end.

18. The smoking accessory of claim 14, wherein the first channel extends from the third end to the fourth end.

19. The smoking accessory of claim 14, wherein the capsule is held within the first channel by friction between the filter wrapper and the elongated structure.

20. The smoking accessory of claim 14, further comprising an outer casing that houses the filter wrapper.

* * * * *